US009789941B2

(12) United States Patent
Smith

(10) Patent No.: US 9,789,941 B2
(45) Date of Patent: Oct. 17, 2017

(54) UNDERWATER BREATHING APPARATUS

(71) Applicant: Scott Andrew Smith, Waterford (CA)

(72) Inventor: Scott Andrew Smith, Waterford (CA)

(73) Assignee: Scott Andrew Smith, Waterford, Ontario (CA)

( * ) Notice: Subject to any disclaimer, the term of this patent is extended or adjusted under 35 U.S.C. 154(b) by 291 days.

(21) Appl. No.: 14/727,603

(22) Filed: Jun. 1, 2015

(65) Prior Publication Data

US 2016/0347432 A1 Dec. 1, 2016

(51) Int. Cl.

| | |
|---|---|
| ***A61M 15/00*** | (2006.01) |
| ***A62B 7/00*** | (2006.01) |
| ***B63C 11/20*** | (2006.01) |
| ***B63C 11/14*** | (2006.01) |

(52) U.S. Cl.

CPC ..... *B63C 11/202* (2013.01); *B63C 11/14* (2013.01)

(58) Field of Classification Search

CPC ..... B63C 11/14; B63C 11/202–11/207
USPC ..... 128/201.11, 201.27, 201.28
See application file for complete search history.

(56) References Cited

U.S. PATENT DOCUMENTS 813,431 A * 2/1906 Iwanami et al. ..... B63C 11/202 114/327
908,690 A * 1/1909 Neubert ..... B63C 11/207 114/66
3,467,091 A * 9/1969 Aragona ..... B63C 11/202 128/201.11
3,951,142 A * 4/1976 Martin ..... B63C 11/207 128/201.11
4,674,493 A * 6/1987 Mitchell ..... B63C 11/202 128/201.11
4,986,267 A * 1/1991 Doss ..... B63C 11/202 128/201.27
5,193,530 A * 3/1993 Gamow ..... B63C 11/14 128/201.27
5,297,545 A * 3/1994 Infante ..... B63C 11/202 114/315
5,327,849 A * 7/1994 Miller ..... B63C 11/202 114/315

(Continued)

*Primary Examiner* — Kristen Matter

(57) ABSTRACT

The invention allows users to be totally submerged underwater with an adequate supply of air for extended periods of time without the use of regulators, pressure vessels, diaphragm pumps or compressors, internal combustion engines or external power sources. The apparatus includes a buoyant enclosure supporting a hollow air intake pipe with a sphere shaped screen mounted on the top. The bottom half of the screen has holes to allow air into an air intake tube and to drain water out. A low pressure blower and filter assembly with a rechargeable and easily replaceable lithium-ion battery are mounted inside the buoyant enclosure. Air is drawn into the low pressure blower suction and through an air filter delivering constant air flow to the individual through an attached flexible air supply hose. Three check valves constrain air flow supply unidirectional to the individual while venting excess air. A hand pump vacates water from the mouthpiece or mask and draws in purging air while the individual is submerged. For stability the apparatus has a low center of gravity creating a strong self-righting moment in calm or rough seas. For safety the apparatus has a grab handle and a tether line connection from the bottom of the buoyant enclosure.

8 Claims, 4 Drawing Sheets

(56) References Cited

U.S. PATENT DOCUMENTS

| | | | | |
|---|---|---|---|---|
| 5,471,976 | A * | 12/1995 | Smith | B63C 11/202<br>128/201.27 |
| 5,535,734 | A * | 7/1996 | Lu | B63C 11/207<br>128/201.11 |
| 7,159,528 | B1 * | 1/2007 | Hilliker | B63C 11/207<br>114/315 |
| 2002/0117172 | A1 * | 8/2002 | Chiang | B63C 11/207<br>128/201.27 |
| 2004/0234343 | A1 * | 11/2004 | Roure | B63C 11/202<br>405/186 |
| 2009/0000617 | A1 * | 1/2009 | Rosenberger | B63C 11/202<br>128/201.27 |
| 2009/0056718 | A1 * | 3/2009 | Lindgren | B63C 11/202<br>128/204.18 |
| 2011/0197881 | A1 * | 8/2011 | Abulrassoul | B63C 11/202<br>128/202.13 |
| 2011/0250577 | A1 * | 10/2011 | Aaberg | A63B 69/12<br>434/254 |
| 2016/0251065 | A1 * | 9/2016 | Lin | B63C 11/26<br>128/201.27 |

* cited by examiner

UNDERWATER BREATHING APPARATUS

BACKGROUND OF THE INVENTION

1. Field of the Invention

The invention relates to an enclosure used to support an underwater breathing apparatus. The apparatus is designed to be used by recreational tourist snorkelers, pool repair and commercial underwater marine surveyors and vessel repair engineers as well as private boat and pool owners. The apparatus allows a swimmer to breath underwater comfortably at limited depths for extended periods of time.

2. Background and Related Art

There are many inventions that provide air to swimmers allowing play and or work underwater. Standard snorkels will not work effectively for most people at depths below three feet. The body's diaphragm muscle cannot overcome the water pressure at depths to allow for natural aspiration. Many examples of providing a supply of pressure regulated air to a diver or swimmer have been developed. The SCUBA or self-contained underwater breathing apparatus was developed in 1952 and described in U.S. Pat. No. 2,593,988. A pressurized tank is worn on the divers back. The air pressure is regulated according to depth and demand as the air is supplied to the diver. The main draw back to the SCUBA is that the diver has to carry a cumbersome pressurized air tank on his or her back. Later developments included a number of products that float independently on the surface of water. Typically these devices use compressors, diaphragm pumps and regulators to supply air and are mounted on a floating platform.

The main drawbacks: Previous devices were typically powered by large electric motors with large heavy wet cell batteries. Alternatively, devices can be powered by internal combustion engines that can possibly contaminate the air supply with fuel or exhaust. These inventions can be prone to mechanical failures associated with compressors, diaphragm pumps and internal combustion engines. Air regulators and pressure switches are dangerous when they fail under use. Devices that turn off and on by use of a pressure switch will use more electric current at start up causing more wear on the electrical switch and equipment. When these machines fail there is no chance for the swimmer to breathe through them even at shallow depths. With no air flow or pressure the water can fill the breathing tube or mask back to the surface. There is no way to vacate water from the mask or mouthpiece and purge with clean air while underwater.

The difference between the applicant's invention and others is that the air supply is by a low pressure blower utilizing a rotating impeller and volute with no other moving parts, pressure switches, regulators or pressure vessels. The filtered air supply is constant and flowing during use. When air is not required by the swimmer it passes the mask or mouthpiece and is vented via a check valve. This insures that an adequate supply of air is always available without using a mechanical regulator. The low pressure blower runs continuously and the power draw is constant making the device much more reliable.

The blower motor uses reliable small and rechargeable lithium-ion batteries that are easily replaced by the user. The air supply is constrained flowing unidirectional by using check valves at the mask or mouth piece that keep water from going back up the air supply line. One can still breathe air by drawing it through the low pressure blower while the low pressure blower is not running and at a shallow depth.

A hand pump is so mounted to allow the swimmer to clear water and purge air at the mask or mouth piece while underwater.

SUMMARY OF THE INVENTION

The main object of the instant invention is to provide an improved, portable, safe, efficient and affordable underwater breathing apparatus that is self-contained, powered by rechargeable lithium-ion or other suitable batteries while eliminating the use of compressors, air pumps, air tanks and air regulators. The said underwater breathing apparatus enables an individual to remain underwater for extended periods of time at a depth limit of ten feet and continue to breathe with comfort. The invention uses a low pressure blower assembly that provides unregulated, filtered air supply to the individual. The low pressure blower batteries can be changed easily and quickly by the individual.

In other underwater breathing devices there tends to be an accumulation of water in the breathing tube and mouthpiece. This is due to either water condensing within the breathing tube, leaky seals or water entering the air intake. After a period of time the individual has to exhale sharply into the mouthpiece to remove this water. However, the path traveled by the expelled water is up the length of the breathing tube and out the air inlet. Therefore it becomes very difficult to expel the water and the purging must be done above the surface of the water.

In naturally aspirated snorkel devices the swimmer is limited to breathing at a shallow depth due to the weakness of the human diaphragm muscle to overcome water pressure. Water can also enter the mouthpiece and travel back up the breathing tube.

In devices that are powered by wet cell batteries or internal combustion engines the risk of air contamination exists. Many underwater breathing devices use compressed, unfiltered air that can be problematic for the air regulator and the individual.

The structure of the present invention obviates these difficulties by providing a number of improvements. The said invention includes a hand pump to remove water within the apparatus while the individual stays submerged. The hand pump will also purge the apparatus with clean air to the individuals face mask or mouthpiece.

It is a an object of the said invention to provide a flow of clean filtered and unregulated air supply to the individual by the use of a low pressure blower. The screens and the air filter used in the said invention keep unwanted airborne contaminates out of the flexible hose.

A still further object of the said invention to stop water from moving back up the breathing tube by utilizing an air intake check valve positioned close to the mouthpiece or facemask.

It is a further object of the said invention to provide a highly stable buoyant enclosure that supports the air intake screen in an upright and out of the water position. The stability of the said invention has a low center of gravity creating a strong righting Moment to keep the air intake sphere out of the water even in windy or rough seas.

It is a further object of the said invention to provide electric power supply using easily replaceable, safe and rechargeable long lasting lithium-ion batteries.

A still further object of the said invention is to operate as a personal floatation device for the individual. This is achieved by adding grab handles and tether line connection mounted to the bottom of the buoyant enclosure.

A still further object of the said invention is to provide an underwater breathing apparatus made from materials selected from a group consisting of polyethylene, polypropylene, polyvinyl chloride, Lucite, Acrylonitrile Butadiene Styrene (ABS), fiberglass, nylon, melt processed rubber, silicone styrene or urethane foams.

The said invention provides air flow to the individual as follows: Air enters the bottom of the air intake screen through holes that allow air in and water to drain out. The air then passes up to the underside of the top portion of the air intake screen. The screen is connected to the air intake pipe. The air then flows through a flexible hose into the low pressure blower suction. The low pressure blower has a compartment for holding any water that has made it past the air intake. The air then travels from the water holding compartment through an air filter and past a float restrictor to the low pressure blower output port. Air leaving the low pressure blower output port now enters the flexible hose and is supplied down to the individual. The air then passes through an air intake check valve mounted close to the swimmers mouthpiece or facemask. This air intake check valve ensures that no water can go back up the flexible hose. Any unused air that is supplied to the mouthpiece or face mask is vented into the water through the exhale check valve mounted close to the mouthpiece or facemask. Some air will also pass down a flexible hose through a hand pump check valve to the hand pump. Stroking the hand pump will draw any water out of the apparatus while at the same time draw air to the mouthpiece or facemask while the individual is submerged under water. The hand pump check valve restricts water from flowing back through the pump and into the mouthpiece or facemask. Continuous pumping will purge air through the whole apparatus and into the water. The arrangement of the three check valves constrain air to flow unidirectional into the mouthpiece or facemask while keeping water out of the apparatus.

DETAILED DESCRIPTION OF THE DRAWINGS

Figure 1:
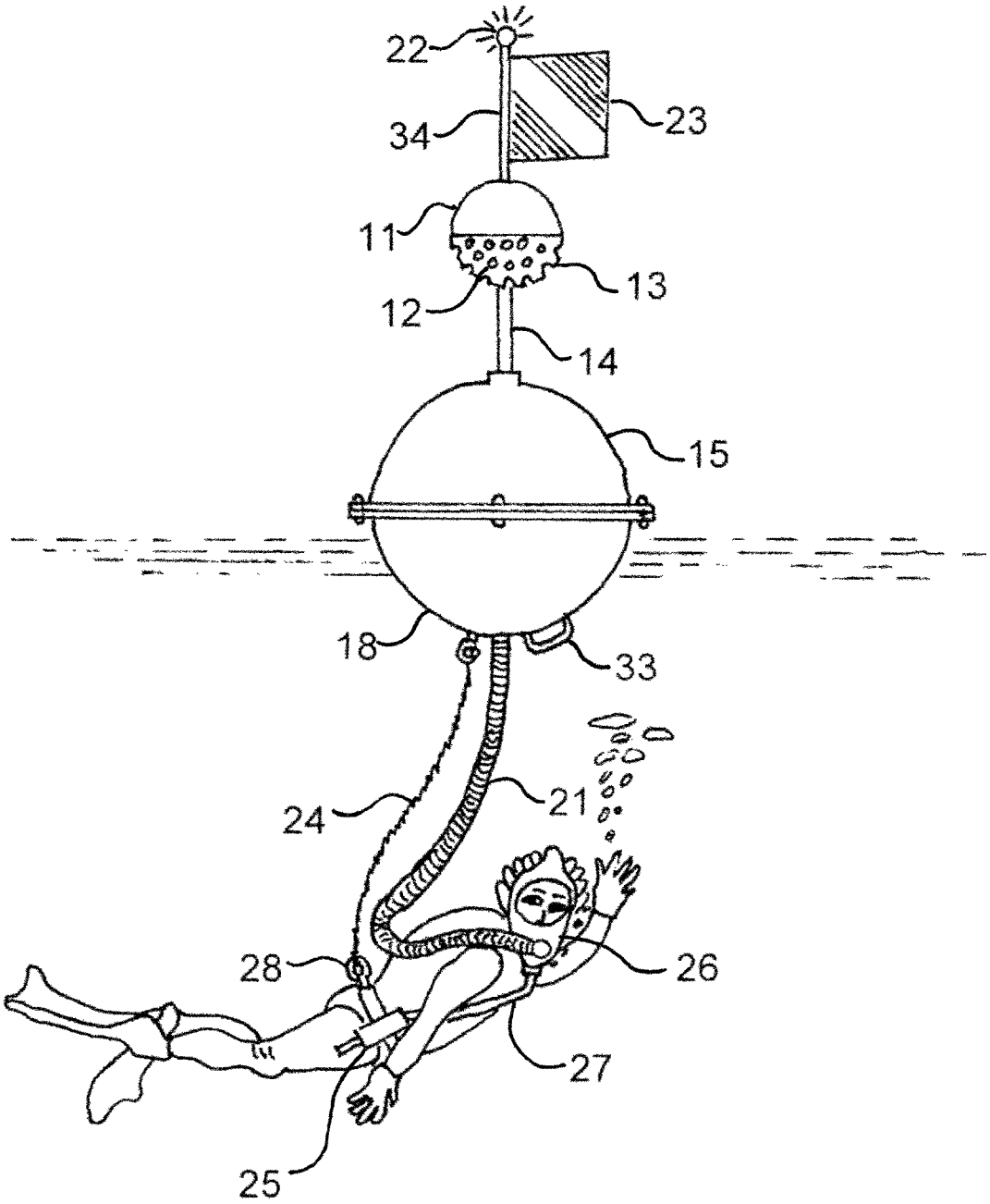
FIG. 1 is an elevation view showing the total embodiment of the present invention.

With reference to FIG. 1 thereof, herein shall be described a new underwater breathing apparatus embodying the principles and concepts of the present invention. More specifically it will be noted that FIG. 1 comprises a sealed, hollow buoyant enclosure in two parts, the bottom half 18 and the top half 15. The top half 15 is removable to access the inside of the buoyant enclosure. Both parts 15 and 18 are connected and sealed during normal use. The buoyant enclosure supports and is connected to an air intake pipe 14. Mounted on the air intake pipe 14 is a two part air intake screen. The air intake screen bottom 13 is attached to the air intake screen top 11. The bottom half of the air intake screen 13 has holes 12 that allow air into the air intake screen and drain water out of the air intake screen. Connected to the top of the air intake screen 11 is a hollow shaft 34. Attached to the hollow shaft 34 is a flag 23. Connected to and mounted on top of the hollow shaft 34 is a light 22. Connected to the bottom of the buoyant enclosure 18 is a grab handle and tether line connection 33. A flexible breathing hose 21 is connected to the bottom of the buoyant enclosure 18 while the other end of the flexible hose 21 is connected to the individuals mask or mouthpiece 26. Connected to the mask or mouthpiece 26 is a flexible hose 27. The other end of flexible hose 27 is connected to the inlet side of a hand pump 25. The tether line 24 is connected at one end to the grab handle and tether connection 33. The other end of the tether line 24 is connected to the individual at a belt mounted eye ring 28.

Figure 2:
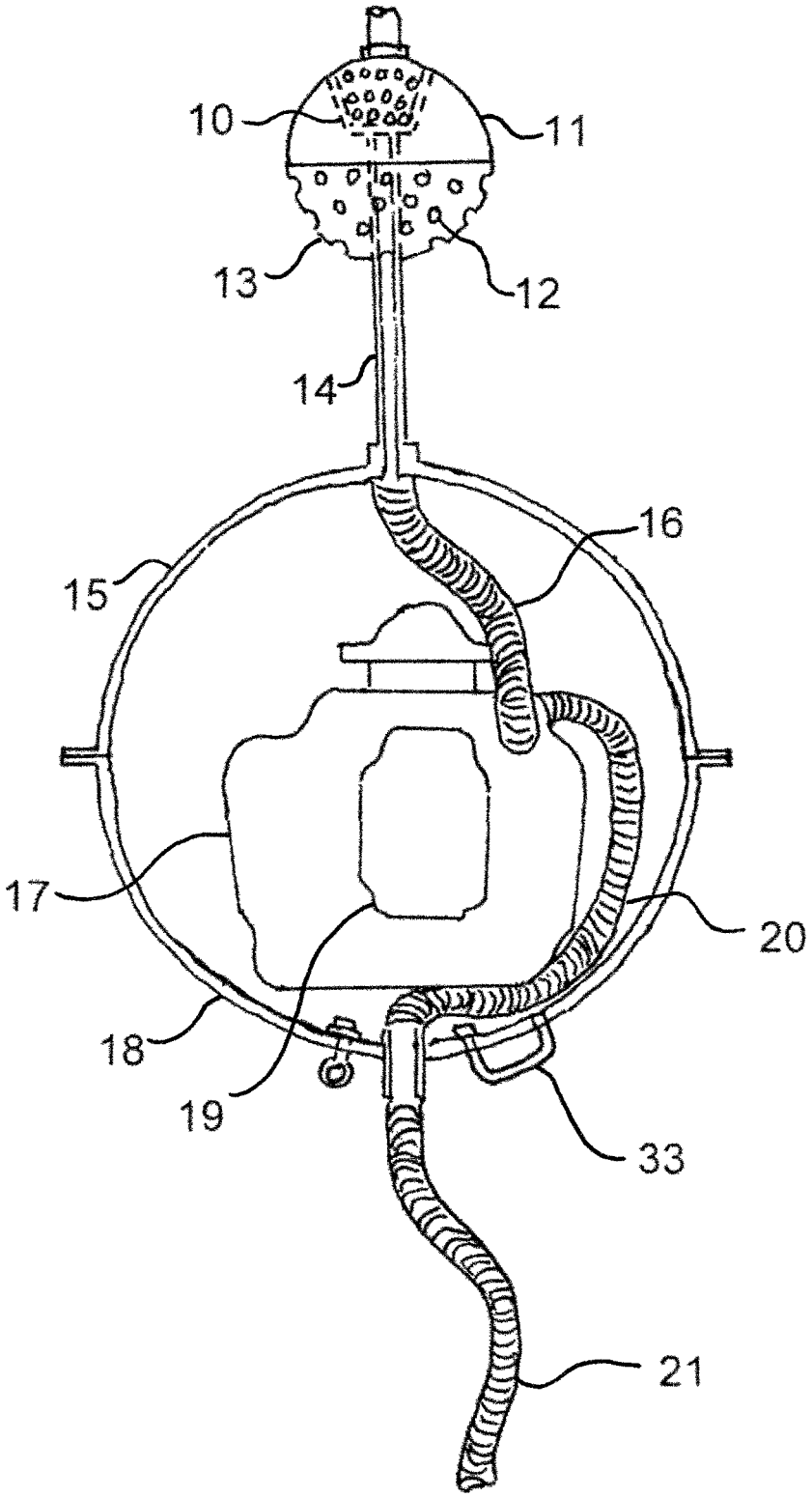
FIG. 2 is a side, cross section view of the embodiment of the air intake screen and the sealed buoyant enclosure.

The underwater breathing apparatus shown in FIG. 1 parts 15, 18, 13 and 11 are shown in greater detail in FIG. 2. Turning now to FIG. 2 we see a side cross section view of the embodiment of the air intake screen parts 11 and 13 and the sealed buoyant enclosure parts 15 and 18. The buoyant enclosure parts 15 and 18 contain the low pressure blower compartment 17. Connected to the low pressure blower compartment 17 is a twenty volt rechargeable lithium-ion battery 19. The low pressure blower compartment 17 air outlet is connected to a flexible hose 20. The other end of flexible hose 20 is connected to the inside and bottom of the buoyant enclosure 18. The low pressure blower compartment 17 air inlet is connected to a flexible hose 16. The other end of flexible hose 16 is connected to the inside and top of 15. On the exterior bottom of the buoyant enclosure 18 is flexible hose 21. Flexible hose 21 is connected to and a continuation of flexible hose 20. Mounted on the exterior top of 15 is an air intake pipe 14. Mounted on top of the air intake pipe 14 is the two part air intake screen 11 and 13. The air intake pipe 14 projects through 13 and is connected to an annular air intake screen 10. The annular air intake screen is mounted to the underside of 11. Air can flow freely through the screen 10 and down the center of the air intake pipe 14.

Figure 3:
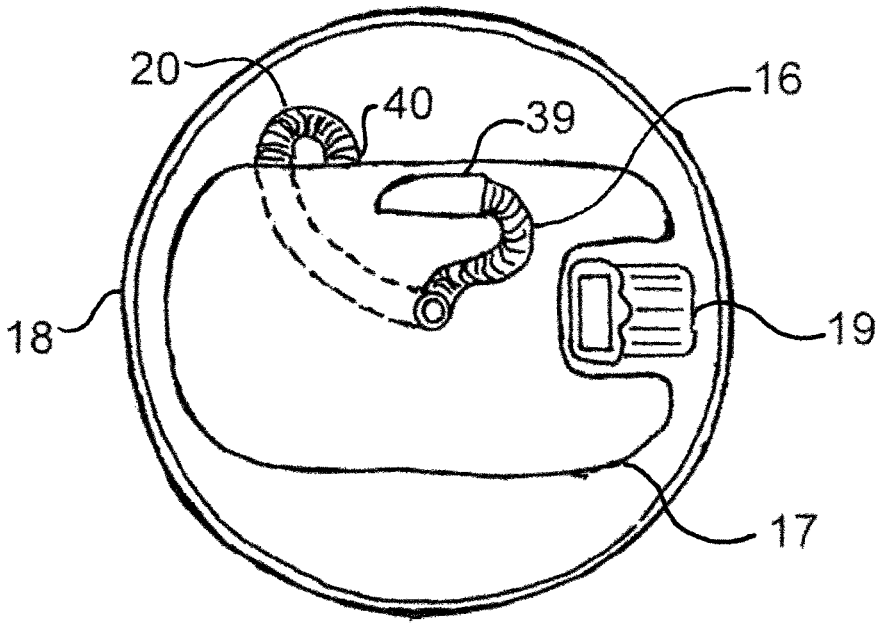
FIG. 3 is the top cross section view of the embodiment of the buoyant enclosure.

Turning now to FIG. 3 we see the top cross section embodiment of the buoyant enclosure. Shown is the bottom of the buoyant enclosure 18 and mounted within 18 is the low pressure blower compartment and water container 17. Attached to the low pressure blower 17 is the twenty volt rechargeable lithium-ion battery 19. From the air inlet port 39 on the low pressure blower 17 is connected a flexible air inlet hose 16. From the outlet port 40 on the low pressure blower 17 is connected a flexible air outlet hose 20.

Figure 4:
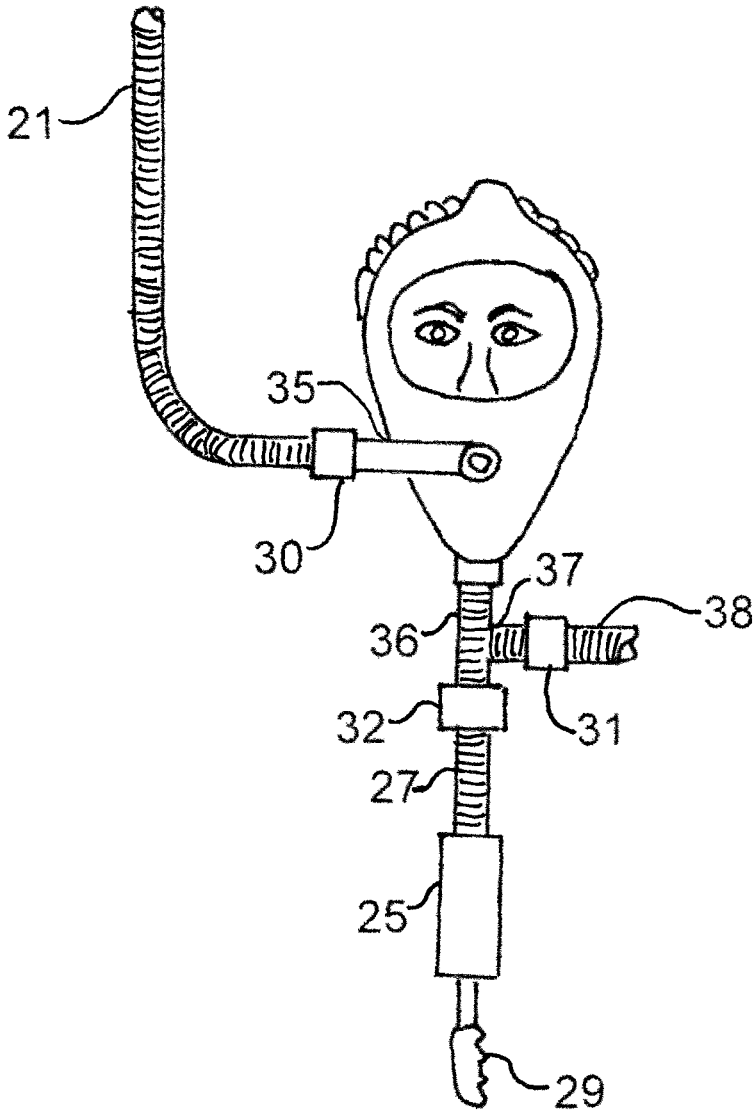
FIG. 4 is a perspective drawing illustrating the check valves and the hand pump arrangement.

Turning to FIG. 4 is a perspective drawing illustrating the check valves and hand pump embodiment of the present invention. The illustration in FIG. 4 shows a dive mask or mouthpiece 26 connected to the breathing tube 21. Connected to the breathing tube 21 is an air inlet check valve 30. Connected to the other side of 30 is a flexible tube 35. The other end of flexible tube 35 is connected to the mask or mouthpiece 26. Flexible tube 35 is a continuation of the breathing tube 21 supplying air to the swimmers mask or mouthpiece 26. From the mask or mouthpiece 26 is connected an exhale flexible tube 36. Flexible tube 36 forms a tee with flexible tube 37. Flexible tube 37 is connected at the opposite end to the exhale check valve 31. Connected onto the discharge side of the exhale check valve 31 is a short flexible hose 38 used to vent exhaled air into the water. Flexible hose 36 is connected from the individuals mask or mouthpiece 26 to the hand pump check valve 32. From the opposite side or the water side of hand pump check valve 32 is connected to a flexible hose 27. The other end of flexible hose 27 is connected to the hand pump 25. Hand pump 25 is stroked by the swimmer using the pump handle 29.

Referring to FIG. 2 low pressure blower housing 17 has battery 19 connected and the power is on. The buoyant enclosure parts 15 and 18 are closed together and sealed. Air is drawn into the low pressure blower 17. The intake air moves through the holes 12 on the air intake sphere parts 11 and 13. Air travels up and under 11 and passes through the annular screen 10 that is mounted to the interior top of 11. The annular screen 10 will stop objects like dust and insects from entering into the air intake pipe 14. Air is drawn down the air intake pipe 14 as the low pressure blower 17 creates a negative pressure. The air then flows down a flexible air intake tube 16 and into the low pressure blower compartment 17. As the air enters the low pressure blower compartment 17. Water that has passed the air intake sphere 11, 13 will be retained in the low pressure blower compartment 17.

Referring to FIG. 3 the air leaves the low pressure blower compartment 17 only after passing through an air filter and passing through an air outlet restrictor float. Air then passes through the air outlet port 40 and down a flexible hose 20. Air then enters the flexible tube 21 and is supplied to the individual.

Referring to FIG. 4 air is supplied down the flexible hose 21 past an air intake check valve 30 that will prevent water from flowing back up the flexible hose 21. As the air supply passes the air intake check valve 30 it flows through the flexible hose 35 to the individuals mask or mouthpiece 26.

As the individual exhales air out of the mask or mouthpiece 26 the exhaled air moves through a tee arrangement 36, 37. Air flows through the flexible hose 37 and through the exhale check valve 31. Exhale air then exits the apparatus through a small hose 38. Any unused air will exit through 37 and 38. The other end of tee 36 and 37 is connected to a hand pump check valve 32. The hand pump check valve prevents water from flowing back to the mask or mouthpiece 26. Connected to the opposite side of 32 is a flexible hose 27. Flexible hose 27 is thus attached to the hand pump 25. When the individual wants to vacate the mask or mouthpiece 26 of water the hand pump is used. The individual has to stroke the hand pump 25 by moving the handle 29 axially in and out. As the hand pump 25 is stroked, water is drawn out of the mask or mouthpiece 26 and down 36, through the hand pump check valve 32. Water is then pulled through the flexible hose 27 and into the hand pump 25. As the hand pump 25 is stroked the piston within the hand pump 25 is stroked. The volume of water vacated per stroke is equal to the displacement of the pump. Water is then vacated and exited the apparatus and into the water through a port on hand pump 25. Continuous stroking of the hand pump 25 will draw fresh air through the apparatus and to the mouthpiece. The swimmer will notice air bubbles being vented into the water by the hand pump 25.

FIG. 2 shows the position of the low pressure blower 17 mounted low in the bottom half of the buoyant enclosure 18. This will provide stability in the said invention by maintaining a low center of gravity of the apparatus. This creates a positive GM where G is the center of gravity and M is the metacenter. This positive GM will give the total embodiment of the buoyant portion of the underwater breathing apparatus a strong righting moment This highly stable buoyant enclosure 18 will now stay upright in rough or windy seas to maintain the upright and out of the water position of the air intake screen parts 11 and 13.

The invention claimed is:

1. A portable underwater breathing apparatus comprising:

a buoyant water resistant enclosure containing a low pressure air blower and an air filter element;

a first flexible hose attached on one end to an outlet of the low pressure air blower and attached on an opposite end to an interior base of the water resistant enclosure;

a second flexible hose attached on one end to an exterior base of the water resistant enclosure and attached on an opposite end to a mouthpiece or facemask configured to deliver air to an individual a third flexible hose connected at one end to an interior top of the water resistant enclosure and attached at an opposite end to an inlet of the low pressure air blower an air intake pipe attached to an exterior top of the water resistant enclosure; and an air intake sphere mounted on a top of the air intake pipe, the air intake sphere including a bottom with holes for allowing air into the air intake sphere and for allowing water to drain out of the air intake sphere.

2. The apparatus as described in claim 1, wherein the low pressure air blower retains water that may pass through the air intake sphere in order to protect the individual by preventing water from entering the facemask or mouthpiece.

3. The apparatus as described in claim 1, further comprising rechargeable lithium-ion batteries mounted inside the water resistant enclosure for powering the low pressure air blower.

4. The apparatus as described in claim 1, further comprising a hand pump to evacuate unwanted water and purge air through the facemask or mouthpiece while the individual is submerged underwater.

5. The apparatus as described in claim 4, further comprising a strap for mounting the hand pump on the individual.

6. The apparatus as described in claim 1, further comprising three check valves constraining air supply to flow unidirectional into the facemask or mouthpiece and venting excess air.

7. The apparatus as described in claim 1, wherein the water resistant enclosure comprises polyethylene, polypropylene, polyvinyl chloride, Lucite, Acrylonitrile Butadiene Styrene (ABS) or other weldable thermoplastic polymers, fiberglass, nylon, melt processed rubber and silicone, styrene or urethane foams.

8. The apparatus as described in claim 1, wherein weight distribution of the apparatus creates a center of gravity of the apparatus below a metacenter of a portion of the water resistant enclosure configured to be underwater during use of the apparatus.

* * * * *